US005403445A

United States Patent [19]

Shimomura et al.

[11] Patent Number: 5,403,445

[45] Date of Patent: Apr. 4, 1995

[54] RECYCLED PAPER FOR ELECTROPHOTOGRAPHY AND IMAGE FORMING METHOD MAKING USE OF THE SAME

[75] Inventors: Yoshinobu Shimomura, Yokohama; Masahiro Imanishi; Takeo Tsunemi, both of Kawasaki; Hiroyuki Katsuki, Tokyo, all of Japan

[73] Assignee: Canon Kabushiki Kaisha, Tokyo, Japan

[21] Appl. No.: 29,229

[22] Filed: Mar. 9, 1993

[30] Foreign Application Priority Data

Mar. 9, 1992 [JP] Japan ..... 4-050635

[51] Int. Cl.[6] ..... D21H 11/14

[52] U.S. Cl. ..... 162/147; 162/149; 162/158; 162/181.2; 162/189

[58] Field of Search ..... 162/147, 158, 4, 5, 162/149, 189, 183, 168.2, 181.2

[56] References Cited

U.S. PATENT DOCUMENTS

| | | | |
|---|---|---|---|
| 4,518,459 | 5/1985 | Freis et al. | 162/5 |
| 4,561,933 | 12/1985 | Wood et al. | 162/5 |
| 4,591,412 | 5/1986 | Hechler | 162/158 |
| 4,818,341 | 4/1989 | Degen et al. | 162/168.2 |
| 4,820,379 | 4/1989 | Darlington | 162/5 |
| 4,913,775 | 4/1990 | Langley et al. | 162/183 |
| 5,122,228 | 6/1992 | Bouchette et al. | 162/4 |
| 5,126,010 | 6/1992 | Kobayashi et al. | 162/158 |
| 5,156,719 | 10/1992 | Passaretti et al. | 162/158 |
| 5,228,954 | 7/1993 | Vinson et al. | 162/147 |
| 5,232,553 | 8/1993 | Smigo et al. | 162/147 |
| 5,238,538 | 8/1993 | Jagannadh et al. | 162/4 |

FOREIGN PATENT DOCUMENTS

| | | | |
|---|---|---|---|
| 58-40556 | 3/1983 | Japan | 162/147 |
| 63-6867 | 1/1988 | Japan . | |

OTHER PUBLICATIONS

"What's available in recycled printing papers?", In Plant Reproductions, vol. 41, No. 5, May 1991, pp. 48–52.

F. Hongo et al., "Paper for electrophotographic copying", Database Paperchen.

J. Casey Editor, "Pulp and Paper Chemistry and Chemical Technology", 3rd Edition, 1983, New York, p. 2286, paragraph 3; p. 2291, paragraph 1.

*Primary Examiner*—Peter Chin

*Attorney, Agent, or Firm*—Fitzpatrick, Cella, Harper & Scinto

[57] ABSTRACT

A recycled paper for electrophotography has a fine class pulp containing a fine class waste paper pulp. The fine class pulp is in a content of not less than 90% by weight based on the weight of the whole pulp. The recycled paper has a waste paper pulp content of more than 70% by weight based on the weight of the whole pulp.

23 Claims, 4 Drawing Sheets

Rz (TEN-POINT AVERAGE ROUGHNESS)

RECYCLED PAPER FOR ELECTROPHOTOGRAPHY AND IMAGE FORMING METHOD MAKING USE OF THE SAME

BACKGROUND OF THE INVENTION

1. Field of the Invention

The present invention relates to a recycled paper for electrophotography, mixed with waste paper pulp, and an image forming method making use of the recycled paper for electrophotography. More particularly, it relates to a recycled paper for electrophotography that is preferable for use in electrophotographic apparatus having a photosensitive member cleaning system in which a cleaning member is brought into contact with a photosensitive member to clean the photosensitive member and/or a fixing cleaning system in which a cleaning member is brought into contact with a fixing roller to clean the fixing roller, and an image forming method that forms an image using the recycled paper for electrophotography in an electrophotographic apparatus having such a system or systems.

2. Related Background Art

In recent years, recycled paper is used as paper for electrophotography from the viewpoint of environmental conservation such as saving of natural resources and saving of energy. Such recycled paper comprises deinked waste paper pulp (hereinafter "DIP") made from waste paper comprised of a mixture of a fine class paper and a middle class paper, which waste paper is exemplified by old newspapers, old magazines and waste leaflets commonly released from homes and papers having been used for line printing in computers.

As for copying machines making use of electrophotography, for example, a photosensitive member having photoconductive characteristics is electrostatically charged by means of a primary corona assembly, followed by exposure to light to form an electrostatic latent image on the photosensitive member, and the latent image is converted to a visible image by the use of a toner of a developer according to a one-component or two-component development system to form a toner image. Thereafter, the toner image formed on the photosensitive member is transferred to recording paper separately transported to that portion, by means of a transfer corona assembly, and then the toner image is, as shown in FIG. 9, fixed to recording paper 4 by the action of heat or pressure, or the both, by means of a fixing assembly 13 comprised of a pair of rollers 9 and 10 (or a roller and a belt). A final copied image is thus obtained. In the course of the transfer step, any paper dust generated from the recording paper 4 and the toner having not been transferred to the recording paper are removed at a cleaner zone 1 shown in FIG. 10, provided at the part posterior to the transfer step to carry out cleaning. By means of a cleaning member 2 (e.g., a cleaning blade) brought into contact with a photosensitive member 3, the surface of the photosensitive member is cleaned, and thereafter the step of charging and so forth is repeated. In the fixing assembly (FIG. 9), the toner having not been transferred to the recording paper and the paper dust generated from the recording paper are also cleaned by means of a cleaning member 11 brought into contact with the fixing roller 9, and a release agent such as silicone oil is applied to the roller.

In such a copying machine, recycled paper which is R-paper containing 25 to 30 by weight of middle class waste paper pulp has been used as the recording paper to carry out various tests to obtain the results as shown in Table 1 below.

TABLE 1

| | R-paper |
|---|---|
| Fine class pulp (joshitu kei pulp): | 75% by weight |
| Middle class waste paper pulp (tyushitu kei koshi pulp): | 25–30% by weight |
| Waste paper pulp content: | 70% by weight |
| Scratches/wear on photosensitive member: | X1 |
| Scratches/wear on fixing roller: | X2 |
| Full-color copied image quality: | X3 |
| Brightness: | 71.2 |
| Dimensional change due to humidity variations: | X4 |
| Occurrence of curl: | X5 |
| Runnability: | X6 |

X1: Visual check on the photosensitive member found conspicuous scratches occurred thereon, which were so serious as to cause faulty images.
X2: Visual check on the fixing roller found conspicuous scratches occurred thereon, which were so serious as to cause faulty images.
X3: Faulty tint and coloring were seen.
X4: Dimensional variations greatly occurred.
X5: Curl greatly occurred.
X6: Faulty paper transport occurred.

That is, as a result of running tests on a copying machine, the R-paper caused scratches on the photosensitive member, and caused faulty images ascribable to the scratches on the photosensitive member. As for the scratches on the fixing roller, they occurred so seriously as to become visible on the roller after running on about 10,000 sheets, and became so deep as to cause faulty images after running on about 20,000 sheets.

FIG. 8 illustrates how scratches have occurred on the fixing roller. The surface of the fixing roller 9 brought into contact with the cleaning member 11 has been scraped at a zone a because of paper dust having adhered to the cleaning member 11. The paper dust 12 having adhered to the position corresponding to the scratched zone a of the cleaning member 11 has been analyzed to reveal that fibers of middle class waste paper pulp are present. It has been confirmed that this is due to the recycled paper made from middle class waste paper pulp, i.e., the recycled paper made from middle class waste paper such as old newspapers and old magazines.

Similarly, fibers of the middle class waste paper pulp have been also found at the zone where the photosensitive member is scraped.

Also in full-color copied images, the R-paper has caused a poor tint and coloring compared with fine class paper, resulting in a remarkable darkness and tone dullness. This is greatly ascribable to the brightness of the recording paper.

In a further experiment, the amount of a filler in the R-paper was varied to obtain the results as shown in Table 2.

TABLE 2

| | Small amount | Large amount |
|---|---|---|
| Occurrence and directionality of curl: | C | A–B |
| Lifetime of paper feed roller: | Long | Short |
| Quantity of paper dust: | A | C |
| Faulty image due to recording paper: | A | C |
| Rz (μm): | 25.1 | 17.4 |

TABLE 2-continued

| | Small amount | Large amount |
|---|---|---|
| Image density unevenness: | C | A |

(transfer efficiency)
A: Good
B: A little poor
C: Poor (faulty images and paper run)

That is, the larger the amount of the filler is, the less the curl tends to occur and also the curl directionality tends to be improved. What is herein meant by the curl directionality is whether several ten sheets of the same kind of paper having been passed through the fixing assembly have curled in a uniform direction or some of them have curled in various directions. The former is deemed to have a directionality, and the latter, no directionality. In this experiment, paper with a smaller amount of filler shows no directionality.

As shown in Table 2, with an increase in the amount of the filler, the paper dust quantity increases and faulty images due to blank area caused by poor transfer may occur. In particular, it has been confirmed that, with an increase in the amount of a filler of a certain type as in the case of, e.g., calcium carbonate, the lifetime of rollers belonging to a paper feed system becomes shorter because of the wear of paper feed rollers, also resulting in an extremely poor paper runnability.

Namely, the use of a filler in a smaller content brings about an advantage for the recording paper used in electrophotography.

Table 2 also shows the relationship between a surface roughness Rz according to 10-point average roughness of the recording paper and an image density unevenness based on transfer efficiency. With a decrease in the content of the filler, the surface roughness Rz increases and the image density unevenness remarkably occurs. As a result of further detailed studies, the image density unevenness due to a decrease in the transfer efficiency during the transfer step has been found to occur as follows: As shown in FIG. 6 showing a result of simulation analysis, an air gap between paper and a toner layer on the surface of a photosensitive member broadens in accordance with the unevenness of the paper surface, i.e., with an increase in the surface roughness, so that equipotential lines at a convex part (a) and a concave part (b) are formed as shown in FIG. 7, an enlarged view of a region-A in FIG. 6, where the potential at a point i in a given toner layer is lower at the concave part (b) than at the convex part (a). Because of this decrease in potential, the toner layer to be transferred to the recording paper becomes thinner at the concave part (b) than at the convex part (a). In other words, the efficiency of the transfer of toner from the photosensitive member to the recording paper decreases to cause a density unevenness.

In addition to the problems as discussed above, there is a demand for high-quality recycled paper that promises a good runnability of recording paper in copying machines and does not cause any irregularity of sheets in sorters which is due to heat curl.

As also disclosed in Japanese Patent Application Laid-open No. 63-6867, waste paper pulp is commonly mixed in a content of about 70% by weight from the viewpoint of the properties required for recycled paper, i.e., dimensional stability against humidity variations and low heat-curl properties and the viewpoint of making paper runnability stable against an increase in stiffness, and also in view of the suitability as recycled paper for existing electrophotography. From another viewpoint of environmental conservation by less disposal, there is a demand for recycled paper mixed with waste paper pulp in a higher content.

The problems discussed above can be summarized as follows:

1. Some kind of paper dust generated causes a photosensitive member to be-scraped by the cleaning member of a developing assembly, causing a remarkable wear, bringing about faulty images and also resulting in a short lifetime of the photosensitive member.
2. Some kind of paper dust generated causes fixing rollers to be scraped at the cleaning zone of a fixing assembly, causing a remarkable wear, bringing about faulty images and also resulting in a short lifetime of the fixing Pollers.
3. Dimensional variations tend to occur with changes in humidity.
4. The heat generated during fixing has influence on an increase in the occurrence of curl.
5. The stiffness of paper is relatively too low to achieve a stable runnability of copy sheets.
6. Because of faulty running of recording paper, no directionality of the heat curl due to fixing may be ensured to increase the occurrence of curl itself, causing irregularity of sheets in sorters.
7. In the case when a filler is contained in a large amount, paper feed rollers may be remarkably scraped and worn to bring about a faulty runnability of paper in copying machines, also resulting in a short lifetime of the paper feed rollers.
8. The paper dust generated from recording paper increases with an increase in the content of a filler; resulting in an increase in paper dust adhering to each corona assembly, and causing faulty charging such as leakage to give faulty images in some instances.

SUMMARY OF THE INVENTION

The present invention intends to provide a recycled paper for electrophotography, mixed with waste paper, that has solved the problems discussed above, and an image forming method making use of such recycled paper.

That is, an object of the present invention is to provide a recycled paper for electrophotography, that can prevent a photosensitive member from being scraped and worn at the cleaning zone of a developing assembly because of paper dust generated, and hence may cause no or less faulty images, and an image forming method making use of such recycled paper.

Another object of the present invention is to provide a recycled paper for electrophotography, that can prevent fixing rollers from being scraped and worn at the cleaning zone of a fixing assembly because of paper dust generated, and hence may cause no or less faulty images, and an image forming method making use of such recycled paper.

Still another object of the present invention is to provide a recycled paper for electrophotography, that may cause no or less dimensional changes accompanied with humidity variations, and an image forming method making use of such recycled paper.

A further object of the present invention is to provide a recycled paper for electrophotography, that may cause less curl even when influenced by the heat generated during fixing, and an image forming method making use of such recycled paper.

A still further object of the present invention is to provide a recycled paper for electrophotography, that may generate less paper dust and hence may cause less adhesion of paper dust to a corona assembly, bringing about no or less faulty charging, and an image forming method making use of such recycled paper.

The present invention provides a recycled paper for electrophotography, comprising a fine class pulp containing a fine class waste paper pulp, wherein said fine class pulp is in a content of not less than 90% by weight based on the weight of the whole pulp, and said recycled paper has a waste paper pulp content of more than 70% by weight based on the weight of the whole pulp.

The present invention also provides an image forming method comprising;

developing an electrostatic latent image on a photosensitive member through a developing means having a toner;

transferring a toner image formed on the photosensitive member by the development using the toner, to a recording material through a transfer means; and fixing the toner image transferred to and formed on the recording material, through a fixing means capable of applying the action of heat, pressure or the both of them;

wherein said image forming method has at least one of a photosensitive member cleaning means to clean the photosensitive member by bringing a cleaning member into contact with the photosensitive member after the step of transfer and a fixing member cleaning means to clean the fixing member by bringing a cleaning member into contact with the fixing member;

said recording material comprising a recycled paper comprising a fine class pulp containing a fine class waste paper pulp, wherein said fine class pulp is in a content of not less than 90% by weight based on the weight of the whole pulp, and said recycled paper has a waste paper pulp content of more than 70% by weight based on the weight of the whole pulp.

DETAILED DESCRIPTION OF THE PREFERRED EMBODIMENTS

Figure 1:
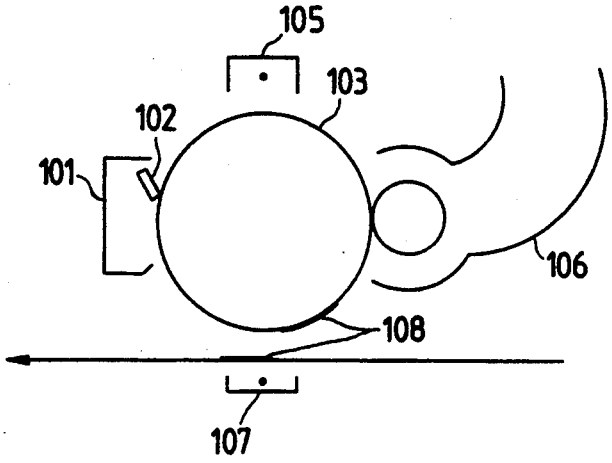
FIG. 1 schematically illustrates an image forming apparatus used in the image forming method of the present invention that forms an image using the recycled paper for electrophotography of the present invention.

AS a result of extensive studies made by the present inventors, the increasing of the content of fine class waste paper pulp selected from among waste paper pulps has made it possible to decrease the content of the middle class waste paper pulp that may cause scratches on the surfaces of photosensitive members and fixing rollers and to use waste paper in content more than 70% in spite of the use of fine class pulp in a content of not less than 90% by weight, so that it has become possible to attain both the properties inherent in fine class paper and the advantages of recycled paper made from waste paper pulp.

In the recycled paper for electrophotography of the present invention, the fine class pulp must be used in a content of not less than 90% by weight, and should preferably be used in a content of not less than 95% by weight.

In the present invention, the fine class pulp includes chemical pulp (virgin pulp) and fine class waste paper pulp. In recycled paper for electrophotography, the use of the fine class pulp in a content of less than 90% by weight results in an increase in the content of middle class waste paper pulp. Hence, when the surfaces of photosensitive members and/or fixing rollers are cleaned by bringing cleaning members into contact with them, the surfaces of photosensitive members and/or fixing rollers tend to be remarkably scraped and worn as a result of running, tending to cause faulty images and also tending to result in a short lifetime of photosensitive members and/or fixing rollers.

Thus, the use of the fine class pulp in a content of not less than 90% by weight may reduce the above problems and can prevent them to a level not questionable. Its use in a content of not less than 95% by weight can be more remarkably effective in this respect.

In the recycled paper for electrophotography of the present invention, the fine class waste paper pulp must be in a content more than 70% by weight, and should preferably be in a content more than 75% by weight.

In the present invention, the waste paper pulp may include fine class waste paper pulp that is waste paper pulp with 100% chemical pulp as exemplified by pulp of wastes from copy paper, computer forms and high white class paper (johaku); and middle class waste paper pulp that is waste paper pulp of wastes made from groundwood pulp (GP) used in newspapers, magazines, middle white class paper (tyuhaku), etc., thermomechanical pulp (TMP), and chemigroundwood pulp (CGP).

In the recycled paper for electrophotography, the use of the waste paper pulp in a content of more than 70% by weight brings about a good dimensional stability against humidity variations, may cause less occurrence of curl by the influence of heat and can provide paper having a high stiffness to make the runnability of paper stable. Its use in a content of more than 75% by weight can be more remarkably effective in this respect.

The fine class waste paper pulp used in the recycled paper for electrophotography of the present invention may preferably have a fiber diameter in the range of from 10 to 70 μm, and more preferably from 10 to 50 μm, in order to prevent photosensitive members and fixing rollers from being scratched and worn.

A filler used in the present invention includes inorganic fine powder such as calcium carbonate, kaolin, talc and titanium dioxide. In view of cost, brightness and neutralization of paper, it is preferred to use calcium carbonate. In particular, among calcium carbonates, heavy calcium carbonate is more preferred in view of its properties that may cause no deterioration of photosensitive members and fixing rollers. Kaolin may also be preferably used in view of its properties that can be free from the influence of the pH of paper and may cause no deterioration of photosensitive members and fixing rollers.

The filler used in the recycled paper for electrophotography of the present invention should preferably have a weight average particle diameter of 20 μm or less, and more preferably a weight average particle diameter of from 1 to 15 μm.

As the filler the use of an inorganic fine powder with a weight average particle diameter of 20 μm or less is preferable since it is suited for making the recycled paper for electrophotography to have a ten-point average roughness Rz of 21 μm or less as will be described later, and also is suited for preventing photosensitive member and fixing rollers from being scratched and worn.

In the recycled paper for electrophotography of the present invention, the filler should preferably be added in an amount not more than 15% by weight, and more preferably not more than 8% by weight.

In the recycled paper for electrophotography, the addition of the filler in an amount not more than 15% by weight can decrease generation of paper dust, so that faulty images due to blank areas cause by poor transfer does not occur or may less occur. Also when an inorganic fine powder with an abrasive action as exemplified by calcium carbonate is used as the filler, the fixing rollers can not be or can be less worn because of its use in a small amount, and paper runnability can be improved. On this occasion, because of the addition of the filler in a small amount, the curl tends to greatly occur and the directionality of curl tends to become unstable. However, in the present invention, the use of the waste paper pulp in a content more than 70% by weight makes it possible to decrease the occurrence of curl caused by the influence of heat and also to stabilize the directionality of curl. Moreover, the addition of the filler in an amount of not more than 15% by weight tends to make the surface roughness of the recycled paper greater as will be described later. Since, however, as previously stated the recycled paper for electrophotography of the present invention has a fine class pulp content as high as 90% by weight or more, it is possible to make the surface roughness smaller and also to make any image density unevenness not occur or less occur.

In the recycled paper for electrophotography of the present invention, the filler contained therein may preferably have a number average particle diameter of 30 μm or less, and preferably in the range of from 3 to 25 μm, when observed using a scanning electron microscope at a magnification of from 150 to 1,000. This is advantageous for preventing photosensitive member and fixing rollers from being scratched and worn.

The recycled paper for electrophotography of the present invention should preferably have a ten-point average roughness Rz of 21 μm or less, and more preferably 16 μm or less.

Figure 3:
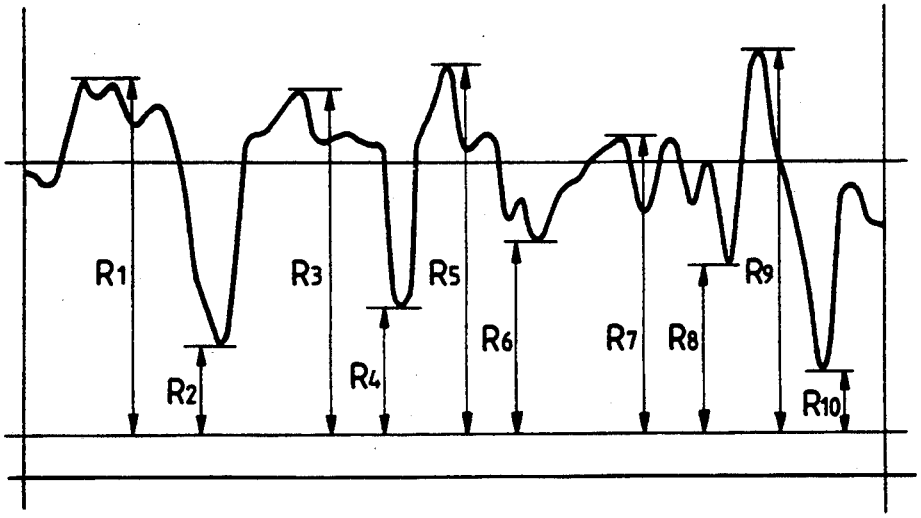
FIG. 3 illustrates a ten-point average roughness Rz of the recycled paper for electrophotography of the present invention.

The ten-point average roughness Rz in recycled paper for electrophotography is a measure that shows the state of the surface of paper as shown in FIG. 3. The greater the value is, the greater the surface unevenness is, where an air gap between paper and a toner layer on the surface of a photosensitive member tends to broaden in accordance with the unevenness. Thus, a difference in equipotential lines between a convex part and a concave part on the surface becomes greater when the ten-point average roughness Rz exceeds 21 μm, to cause a difference in potential. This difference makes transfer efficiency non-uniform when toner is transferred from the drum to the paper, resulting in a density unevenness at a level visually recognizable.

In the present invention, the ten-point average roughness Rz can be controlled to be 21 μm or less by, for example, control of pulp fibers, adjustment of the amount of the filler to be added, adjustment of beating degree, draining direction of at the wire part and pressing at the press part in the course of making paper, and adjustment of pressure during calandaring.

In the present invention, the ten-point average roughness Rz of paper is measured according to JIS B0601-1982 in the following way: Using a surface roughness measuring device Surfcorder SE-30H (Kosaka Kenkyusho K. K.), the surface roughness is measured at a standard length of 2.5 mm and a feed rate of 0.1 mm/sec.

In the recycled paper for electrophotography of the present invention, its basis weight should preferably be in the range of from 60 to 90 g/cm$^2$, and more preferably in the range of from 64 to 80 g/m$^2$. The basis weight in the case of recycled paper for electrophotography expresses the weight of paper per given area. The paper runnability can be stable and also no excess calories are required during the fixing of toner so long as the above numerical values are within the above range. Accordingly, the basis weight can be controlled within the above range of numerical values by controlling the concentration of pulp and speed at the wire part in the course of making paper.

In the present invention, the basis weight of the recycled paper for electrophotography is the value measured according to JIS P8124-1976.

In the recycled paper for electrophotography of the present invention, its moisture content should preferably be from 3.5 to 6%, and more preferably from 4 to 5%. In recycled paper for electrophotography, the moisture content is one of factors to stabilize the heat curl during heat fixing when copies are taken and to control the dimensional stability against environmental variations.

In the present invention, the moisture content can be controlled by, for example, selecting the types of pulp fibers and controlling the temperature at the dry part in the course of making paper. The recycled paper for electrophotography having a moisture content of from 3.5 to 6% can make stable the heat curl that may occur in the heat fixing when copies are taken, and also can make higher the dimensional stability against environmental variations such as humidity variations.

In the present invention, the moisture content of the recycled paper for electrophotography is the value measured according to JIS P8002-1959.

In the recycled paper for electrophotography of the present invention, its brightness should preferably be 75% or more, and more preferably 78% or more. In recycled paper for electrophotography, the brightness is a value of physical properties that indicates the whiteness of paper. In recycled paper for electrophotography, it is an important factor for improving reproducibility and coloring properties, in particular, in color copying.

In the present invention, the brightness can be controlled within the above range by, for example, selecting fibers of pulp, improving deinkability in the deinking step in the course of making paper, selecting the types of fillers and controlling the amount of additives. In recycled paper for electrophotography, the paper with a brightness of 75% or more can achieve a faithful color reproducibility when copies are taken and give excellent coloring properties.

In the present invention, the brightness of the recycled paper for electrophotography is the value measured according to JIS P8123-1961.

In the recycled paper for electrophotography of the present invention, its stiffness M/C should preferably be $85\pm10$ $cm^3/100$ in length and $40\pm10$ $cm^3/100$ in breadth, and more preferably $90\pm5$ $cm^3/100$ in length and $45\pm5$ $cm^3/100$ in breadth. In recycled paper for electrophotography, the stiffness M/C is a measure to show the hardness of paper, and in an important factor concerned with the runnability of paper when copies are taken.

In the present invention, the stiffness M/C can be controlled within the above range by, for example, selecting the types of fibers of pulp and controlling the beating degree. In recycled paper for electrophotography, the paper with a stiffness of $85\pm10$ $cm^3/100$ in length brings about a stable runnability of paper when copies are taken.

In the present invention, the stiffness of the recycled paper for electrophotography is the value measured according to JIS P8143-1967.

In the present invention, the recycled paper for electrophotography can be grouped into acidic paper having a pH smaller than 7.0 as the pH of paper-extracted water and neutralized paper having a pH 7.0 or above. When such acidic paper or neutralized paper is produced, the pH in the state where waste paper pulp and additives such as a sizing agent, a fixing agent and a filler have been added to water to prepare a paper-making material can be adjusted by controlling the kind and amount of the fixing agent such as aluminum sulfate.

Stated specifically, the pH in the state where waste paper pulp and additives such as a sizing agent, a fixing agent and a filler have been added to water to prepare a paper-making material may be adjusted to about 3.8 to 6 by adding a fixing agent such as aluminum sulfate, whereby the acidic paper can be produced. On the other hand, the pH in the state where such a paper-making material has been prepared may be adjusted to about 7 to 8 by adding no fixing agent such as aluminum sulfate or adding it in a trace amount, whereby the neutralized paper can be produced.

In the case when the pH in the state where the paper-making material has been prepared is 7 to 8, neutral or weak alkaline, it is possible, and preferable, to use an alkaline filler as exemplified by the calcium carbonate previously described, effective for superior brightness and cost performance.

The recycled paper for electrophotography of the present invention can be produced by, for example, the method as described below.

Figure 4:
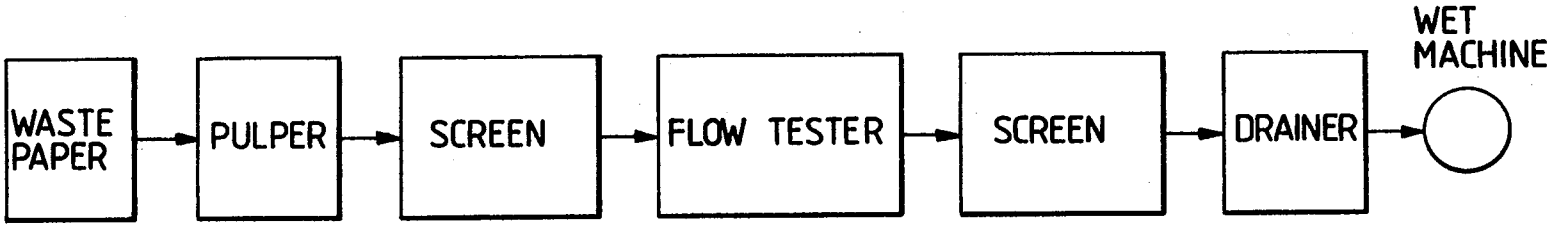
FIG. 4 shows a flow chart of the steps of producing deinked waste paper pulp in a process for making the recycled paper for electrophotography of the present invention.

FIG. 4 schematically illustrates the production of deinked waste paper pulp.

A starting material waste paper is dissolved in a pulper together with a higher alcohol type deinking agent, and the solution is passed through a screen to remove foreign matters. Then a deinking agent is further added to carry out deinking by means of a flow tester, and the deinked material is again passed through a screen, and then drained in a drainer, followed by winding up using a wet machine. The deinked waste paper pulp is thus prepared.

Figure 5:
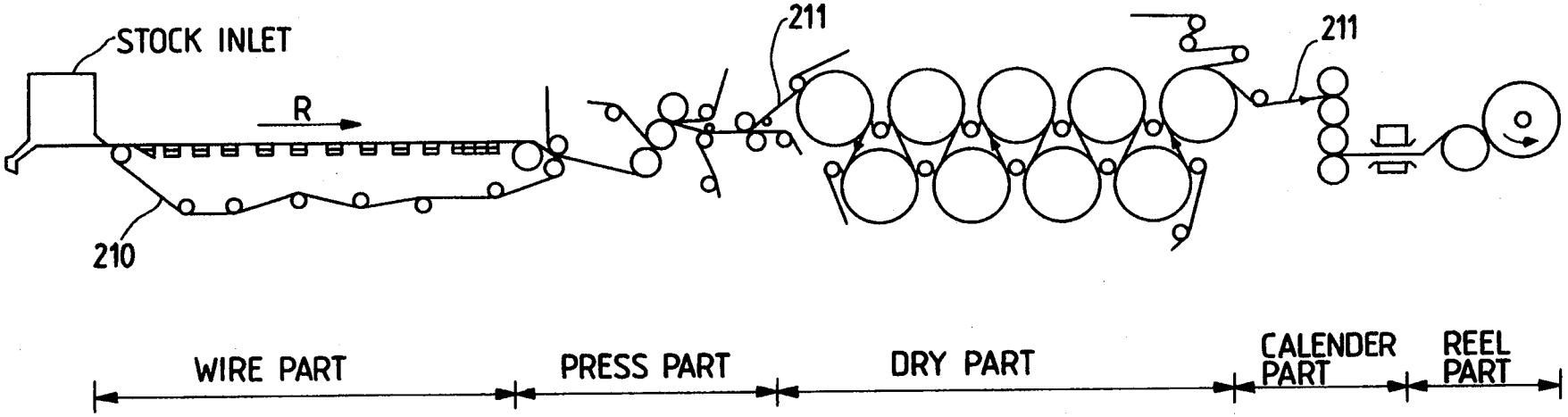
FIG. 5 illustrates how to make paper using deinked waste paper pulp in a process for making the recycled paper for electrophotography of the present invention.
Figure 6:
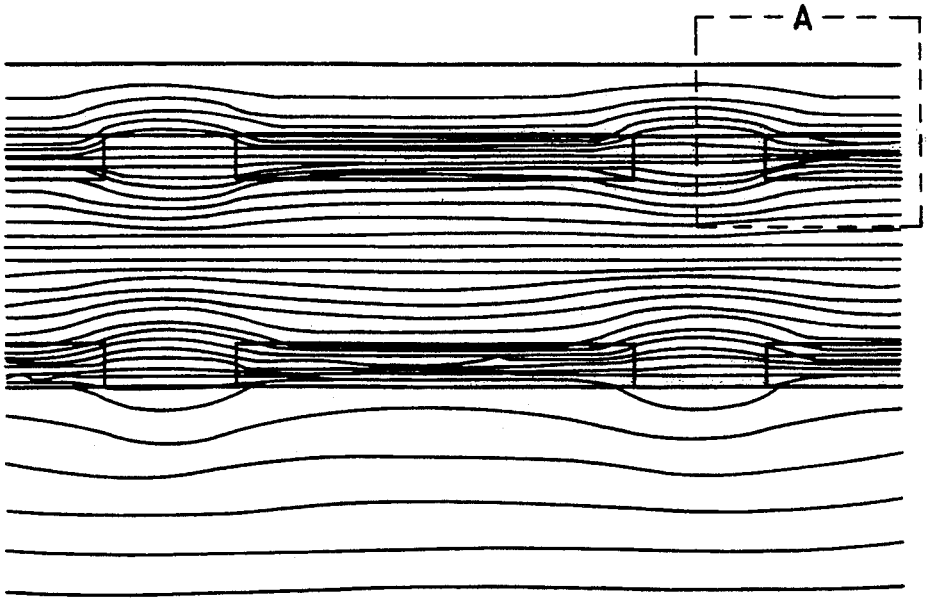
FIG. 6 illustrates the relationship between the surface unevenness of paper and equipotential lines.
Figure 7:
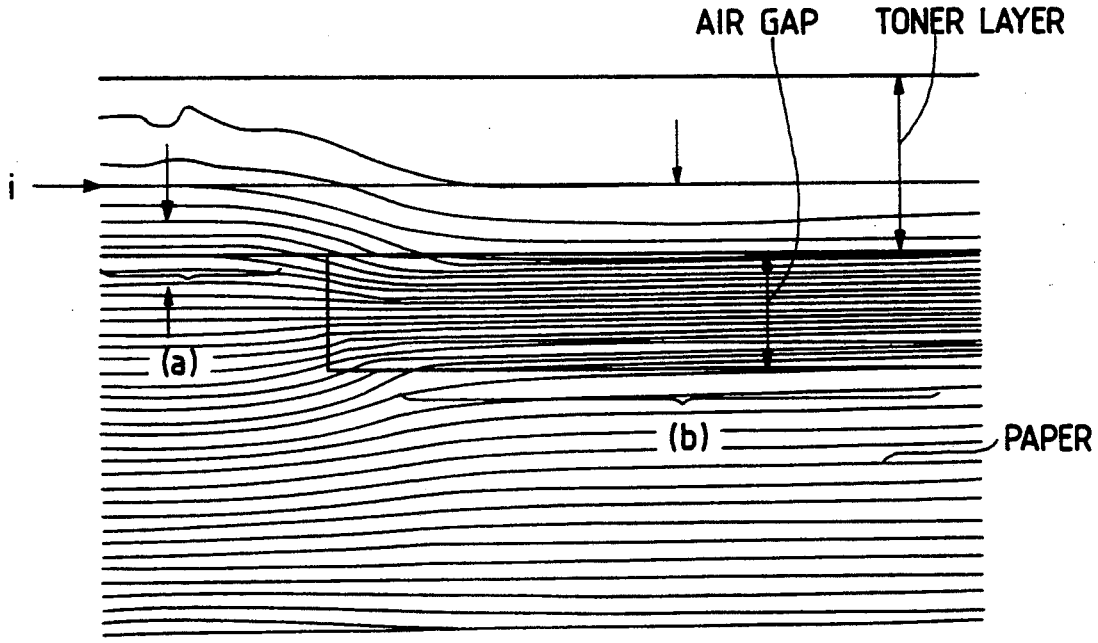
FIG. 7 illustrates a partial enlargement of a region-A in FIG. 6.
Figure 8:
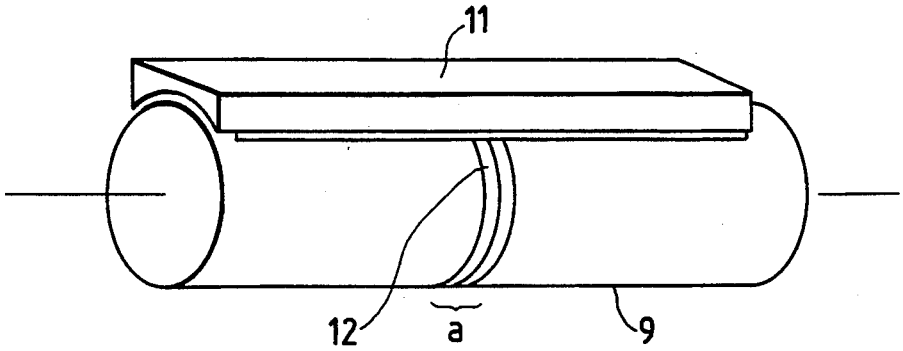
FIG. 8 illustrates scratches on a fixing roller.
Figure 9:
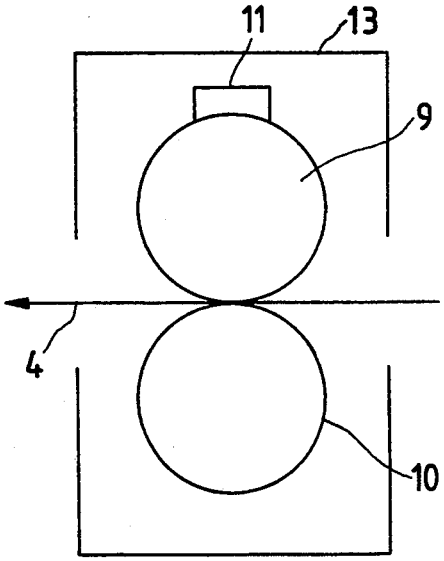
FIG. 9 schematically illustrates a fixing assembly of a usual image forming apparatus.
Figure 10:
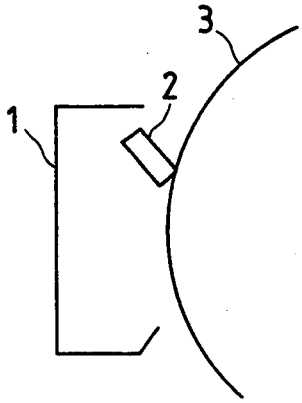
FIG. 10 schematically illustrates a cleaning zone of a photosensitive member of a usual image forming apparatus.

FIG. 5 illustrates a paper-making process carried out using a Fourdrinier paper machine after mixing in the above deinked waste paper pulp a filler and chemicals such as an internal-additive sizing agent. A pulp suspension prepared is jetted from a stock inlet to a wire 210 moving in the direction of an arrow R, and the greater part of water thereof is removed at the wire part. A pulp sheet 211 thus formed is passed through a press part, a dry part, a calender part and a reel part. Thus the paper is produced.

The image forming method making use of the recycled paper for electrophotography of the present invention will be described below with reference to FIGS. 1 and 2.

Figure 2:
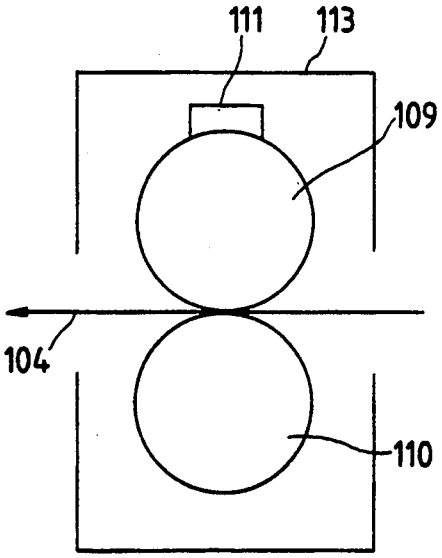
FIG. 2 schematically illustrates a fixing assembly used in the image forming method of the present invention that forms an image using the recycled paper for electrophotography of the present invention.

FIG. 1 illustrates an electrophotographic apparatus of the type in which the recycled paper for electrophotography of the present invention is used. A photosensitive member 103 having photoconductive characteristics is electrostatically charged by means of a primary corona assembly 105, followed by exposure to light to form an electrostatic latent image on the photosensitive member. The latent image thus formed is converted to a visible image to form a toner image, by the use of a toner 108 in a one-component developer or a two-component developer held in a developing assembly 106 serving as a developing means. Thereafter, the toner image thus formed on the photosensitive member is transferred to recording paper 104 serving as a recording material separately transported to that portion, by means of a transfer corona assembly 107 serving as a transfer means, and then the toner image is, as shown in FIG. 2, fixed to the recording paper 104 by applying the action of heat or pressure, or the both, by means of a fixing assembly 13 serving as a fixing means comprised of a pair of rollers 109 and 110 (or a roller and a belt). A final copied image is thus obtained. In the course of the transfer step, any paper dust generated from the recording paper 104 and the toner 108 having not been transferred to the recording paper 104 are removed at a cleaner zone 101 provided at the part posterior to the transfer step to carry out cleaning. By means of a cleaning member 102 (e.g., a cleaning blade) brought into contact with the photosensitive member 103 at the cleaner zone 101, the surface of the photosensitive member 103 is cleaned, and thereafter the step of charging and so forth is repeated. In the fixing assembly, as shown in FIG. 2, the toner having not been transferred to the recording paper and the paper dust generated from the recording paper 104 are also cleaned by means of a cleaning member 111 brought into contact with the fixing roller 109, and a release agent such as silicone oil is applied to the roller.

The recycled paper for electrophotography of the present invention comprises the fine class pulp in a content of not less than 90% and has a waste paper pulp content of more than 70% by weight. Hence, the paper can have both the properties inherent in fine class paper pulp and the advantages of recycled paper made from waste paper pulp. This makes it possible to make smaller the ten-point average roughness Rz of the surface of paper even when the filler is added in a smaller amount, to make curl less occur and to make the directionality of curl stable. Thus, it is possible to decrease paper dust and to make images free from, or less undergo, density uneveness.

When the above recycled paper is used in the image forming method having the photosensitive member cleaning means to clean the photosensitive member by bringing a cleaning member into contact with the photosensitive member and/or the fixing member cleaning means to clean the fixing member by bringing a cleaning member into contact with the fixing member, it is possible to prevent the photosensitive member and the fixing member from being scraped and worn, so that any faulty images can not occur or can be prevented.

In the recycled paper for electrophotography of the present invention and the image forming method making use of the recycled paper, the recycled paper comprises the fine class pulp in a content of not less than 90% by weight and has a waste paper pulp content of more than 70% by weight. Hence, even in its use in electrophotographic apparatus having a photosensitive member cleaning system to clean the photosensitive member by bringing a cleaning member into contact with the photosensitive member and/or a fixing roller cleaning system to clean the fixing roller by bringing a cleaning member into contact with the fixing roller, the photosensitive member can be prevented from being scraped and worn at the cleaning zone of a developing assembly because of paper dust generated, so that any faulty images can not occur or can be made to less occur, and the fixing roller can also be prevented from being scraped and worn, so that any faulty images can not occur or can be made to less occur.

In addition, any dimensional changes accompanied by humidity variations can be prevented and at the same time the curl may less occur even when influenced by the heat generated during fixing. Generation of paper dust also can be decreased to cause less adhesion of paper dust to a corona assembly, bringing about no or less faulty charging.

EXAMPLES

The present invention will be described below in greater detail by giving Examples. These Examples by no means limit the present invention.

Example 1

According to the process for producing deinked waste paper pulp as shown in FIG. 4, fine class waste paper used as a waste paper material was dissolved in the pulper together with a higher alcohol type deinking agent, and the solution was passed through the screen to remove foreign matters. Then a deinking agent was further added to carry out deinking by means of the flow tester, and the deinked material was again passed through the screen, and then drained in the drainer, followed by winding up using the wet machine. Deinked waste paper pulp was thus prepared.

A mixture having a waste paper pulp content of 75% by weight and comprised of the fine class pulp in a content of 100% by weight was obtained by mixing 25% by weight of chemical pulp and 75% by weight of the fine class waste paper pulp obtained in the manner described above. To the mixture, 5% by weight of kaolin was mixed as a filler and aluminum sulfate was further added to obtain a paper-making material. This paper-making material had a pH of 5.4.

The waste paper pulp content is meant to be, as in Table 3, the total of b. fine class waste paper pulp (pulp of wastes from copy paper, computer forms and high white class paper) and c. middle class waste paper pulp (pulp of wastes made from groundwood pulp (GP) used in newspapers, magazines, middle white class paper, etc., thermomechanical pulp (TMP), and chemigroundwood pulp (CGP)). The content of the fine class pulp is meant to be the total of a. chemical pulp (virgin pulp) and b. fine class waste paper pulp.

Using the above mixed material and according to the paper-making process as shown in FIG. 5, paper was made while adjusting paper qualities such as basis weight, moisture content, stiffness, brightness and ten-point average roughness Rz by adjusting the amount of a filler added and controlling paper-making conditions such as beating degree, draining at the wire part, pressure at the press part, temperature at the dry part and pressure at the calender part. The paper thus made was cut using LENOX Automatic Cutter to produce recycled paper and, using this recycled paper, images were formed. Test data such as paper qualities of this recycled paper, scratches on the photosensitive member, scratched on the fixing rollers, quantity of wear, image quality, heat curl, practical paper running and paper dust quantity are shown in Table 3.

Scratches and wear of the photosensitive member, scratches and wear of the fixing rollers and faulty images were examined when 20,000 copy sheets were passed through a copying machine FC-5, manufactured by Canon Inc., having the image forming apparatus as shown in FIG. 1. Heat curl and practical paper runnability were examined when copy sheets were passed through a copying machine NP-9800, manufactured by Canon Inc., having the fixing assembly as shown in FIG. 2. The quantity of paper dust was judged by examining how the transfer corona assembly was stained by paper dust when 100,000 copy sheets were similarly passed through NP-9800.

Example 2

Deinked waste paper pulp was obtained in the same manner as in Example 1 except that the fine class waste paper pulp as used in Example 1 was replaced with a waste paper pulp material comprised of fine class waste paper and middle class waste paper. The fine class waste paper and middle class waste paper were used in such a proportion that the pulp mixing percentage including the percentage of chemical pulp came to be as follows:

A mixture having a waste paper pulp content of 85% by weight and comprised of the fine class pulp in a content of 90% by weight was obtained by mixing 15% by weight of chemical pulp (virgin pulp) and 75% by weight and 10% by weight, respectively, of the fine class waste paper pulp and middle class waste paper pulp obtained in the manner described above. To the mixture, 7.9% by weight of heavy calcium carbonate was mixed as a filler to obtain a paper-making material (pH: 7.7). Paper was made in the same manner as in Example 1 except for use of this paper-making material, and images were also formed in the same manner as in Example 1 to carry out tests to examine paper qualities, scratches on the photosensitive member, scratches on the fixing rollers, wear, heat curl, paper dust quantity, etc.

Results obtained are shown in Table 3.

Examples 3 & 4

Two kinds of paper were made in the same manner as in Example 2 except that the amount of the heavy calcium carbonate added as a filler was changed to 4.5% by weight and 17.0% by weight, respectively images were also formed in the same manner as in Example 2 to carry out tests to examine paper qualities, scratches on the photosensitive member, scratches on the fixing rollers, wear, heat curl, paper dust quantity, etc.

Results obtained are shown in Table 3.

Examples 5

Paper was made in the same manner as in Example 2 except that the amount of the heavy calcium carbonate added as a filler was changed to 18.0% by weight and the calandaring was carried out at a little lower pressure than in Example 2. Images were also formed in the same manner as in Example 2 to carry out tests to examine paper qualities, scratches on the photosensitive member, scratches on the fixing rollers, wear, heat curl, paper dust quantity, etc.

Results obtained are shown in Table 3.

Example 6

The chemical pulp and fine class waste paper pulp as used in Example 1 were used in such a proportion that the pulp mixing percentage came to be as follows:

A mixture having a waste paper pulp content of 85% by weight and comprised of the fine class pulp in a content of 100% by weight was obtained by mixing 15% by weight of chemical pulp (virgin pulp) and 85% by weight of the fine class waste paper pulp obtained in the manner described above. To the mixture, 7.8% by weight of precipitated calcium carbonate was mixed as a filler to obtain a paper-making material (pH: 7.7). Paper was made in the same manner as in Example 1 except for use of this paper-making material, and images were also formed in the same manner as in Example 1 to carry out tests to examine paper qualities, scratches on the photosensitive member, scratches on the fixing rollers, wear, heat curl, paper dust quantity, etc.

Results obtained are shown in Table 3.

Comparative Example 1

Deinked waste paper pulp was obtained in the same manner as in Example 1 except that the fine class waste paper pulp as used in Example 1 was replaced with a waste paper pulp material comprised of fine class waste paper and middle class waste paper, and the amount of the deinking agent was decreased in the deinking and bleaching steps. The fine class waste paper and middle class waste paper were used in such a proportion that the pulp mixing percentage came to be as follows:

A mixture having a waste paper pulp content of 100% by weight and comprised of the fine class pulp in a content of 40% by weight was obtained by mixing 0% by weight of chemical pulp (virgin pulp) and 40% by weight and 60% by weight, respectively, of the fine class waste paper pulp and middle class waste paper pulp obtained in the manner described above. To the mixture, 22% by weight of kaolin was mixed as a filler and aluminum sulfate was further added to obtain a paper-making material (pH: 5.2). Paper was made in the same manner as in Example 1 except that this paper-making material was used and the paper-making conditions such as conditions of the flow tester and conditions of calandaring were changed as shown below. Images were also formed in the same manner as in Example 1 to carry out tests to examine paper qualities, scratches on the photosensitive member, scratches on the fixing rollers, wear, heat curl, paper dust quantity, etc.

Brightness was adjusted by making smaller the amount of the deinking agent than that in Examples 1 and 2 in the deinking and bleaching steps and also changing the flow tester to be made up of one stage. The surface roughness was adjusted by carrying out the calendering at a little lower pressure than in Examples 1 and 2.

Results obtained are shown in Table 3.

Comparative Example 2

Deinked waste paper pulp was obtained in the same manner as in Example 1 except that the fine class waste paper pulp as used in Example 1 was replaced with a waste paper pulp material comprised of fine class waste paper and middle class waste paper, and the amount of the deinking agent was decreased in the deinking and bleaching steps. The fine class waste paper and middle class waste paper were used in such a proportion that the pulp mixing percentage came to be as follows:

A mixture having a waste paper pulp content of 50% by weight and comprised of the fine class pulp in a content of 66% by weight was obtained by mixing 50% by weight of chemical pulp (virgin pulp) and 16% by weight and 34% by weight, respectively, of the fine class waste paper pulp and middle class waste paper pulp obtained in the manner described above. To the mixture, 3.8% by weight of kaolin was mixed as a filler and aluminum sulfate was further added to obtain a paper-making material (pH: 5.5). Paper was made in the same manner as in Example 1 except that this paper-making material was used and the paper-making conditions such as conditions of the flow tester and conditions of calandaring were changed as shown below. Images were also formed in the same manner as in Example 1 to carry out tests to examine paper qualities, scratches on the photosensitive member, scratches on the fixing rollers, wear, heat curl, paper dust quantity, etc.

Brightness was adjusted in the same manner as in Comparative Example 1 except that the time for the flow tester was made a little longer. The surface roughness was adjusted by carrying out the calendering at a little higher pressure than in Comparative Example 1 (a little lower than in Example 1).

Results obtained are shown in Table 3.

Comparative Example 3

Deinked waste paper pulp was obtained in the same manner as in Example 1 except that the fine class waste paper pulp as used in Example 1 was replaced with a waste paper pulp material comprised of fine class waste paper and middle class waste paper, and the amount of the deinking agent was decreased in the deinking and bleaching steps. The fine class waste paper and middle class waste paper were used in such a proportion that the pulp mixing percentage came to be as follows:

A mixture having a waste paper pulp content of 68% by weight and comprised of the fine class pulp in a content of 40% by weight was obtained by mixing 32% by weight of chemical pulp (virgin pulp) and 8% by weight and 60% by weight, respectively, of the fine class waste paper pulp and middle class waste paper pulp obtained in the manner described above. To the mixture, 22% by weight of heavy calcium carbonate was mixed as a filler to obtain a paper-making material (pH: 7.6). Paper was made in the same manner as in Example 1 except that this paper-making material was used and the paper-making conditions such as conditions of the flow tester and conditions of calendering were changed as shown below. Images were also formed in the same manner as in Example 1 to carry out tests to examine paper qualities, scratches on the photosensitive member, scratches on the fixing rollers, wear, heat curl, paper dust quantity, etc.

Brightness was adjusted in substantially the same manner as in Comparative Example 1 (making smaller the amount of the deinking agent than that in Examples 1 and 2 in the deinking and bleaching steps and also changing the flow tester to be made up of one stage). The surface roughness was also adjusted according to substantially the same calendering conditions as in Comparative Example 1 (carrying out the calendering at a little lower pressure than in Examples 1 and 2).

Results obtained are shown in Table 3.

Comparative Example 4

Deinked waste paper pulp was obtained in the same manner as in Example 1 except that the fine class waste paper pulp as used in Example 1 was replaced with a waste paper pulp material comprised of fine class waste paper and middle class waste paper. The fine class waste paper and middle class waste paper were used in such a proportion that the pulp mixing percentage came to be as follows:

A mixture having a waste paper pulp content of 75% by weight and comprised of the fine class pulp in a content of 65% by weight was obtained by mixing 25% by weight of chemical pulp (virgin pulp) and 40% by weight and 35% by weight, respectively, of the fine class waste paper pulp and middle class waste paper pulp obtained in the manner described above. To the mixture, 5.0% by weight of kaolin was mixed as a filler and aluminum sulfate was further added to obtain a paper-making material (pH: 5.0). Paper was made in the same manner as in Example 1 except for use of this paper-making material, and images were also formed in the same manner as in Example 1 to carry out tests to examine paper qualities, scratches on the photosensitive member, scratches on the fixing rollers, wear, heat curl, paper dust quantity, etc.

Results obtained are shown in Table 3.

Comparative Example 5

Deinked waste paper pulp was obtained in the same manner as in Example 1 except that the fine class waste paper pulp as used in Example 1 was replaced with a waste paper pulp material comprised of fine class waste paper and middle class waste paper. The fine class waste paper and middle class waste paper were used in such a proportion that the pulp mixing percentage came to be as follows:

A mixture having a waste paper pulp content of 50% by weight and comprised of the fine class pulp in a content of 90% by weight was obtained by mixing 50% by weight of chemical pulp (virgin pulp) and 40% by weight and 10% by weight, respectively, of the fine class waste paper pulp and middle class waste paper pulp obtained in the manner described above. To the mixture, 5.0% by weight of kaolin was mixed as a filler and aluminum sulfate was further added to obtain a paper-making material. Paper was made in the same manner as in Example 1 except for use of this paper-making material, and images were also formed the same manner as in Example 1 to carry out tests to examine paper qualities, scratches on the photosensitive member, scratches on the fixing rollers, wear, heat curl, paper dust quantity, etc.

Results obtained are shown in Table 3.

TABLE 3

| | Example | | | |
|---|---|---|---|---|
| | 1 | 2 | 3 | 4 |
| Pulp content: (wt. %) | | | | |
| a. Chemical pulp: (virgin pulp) | 25 | 15 | 15 | 15 |
| b. Fine class waste paper pulp: | 75 | 75 | 75 | 75 |
| c. Middle class waste paper pulp: | 0 | 10 | 10 | 10 |
| b. + c.*: | 75 | 85 | 85 | 85 |
| a. + b.**: | 100 | 90 | 90 | 90 |
| Amount of filler: (wt. %) | | | | |
| Calcium carbonate: | — | 1)7.9 | 1)4.5 | 1)17.0 |
| Kaolin: | 5.0 | — | — | — |
| Paper qualities: | | | | |
| pH of paper-making material: | 5.4 | 7.7 | 7.8 | 7.6 |
| Basis weight (g/m$^2$): | 68.8 | 68.6 | 68.0 | 68.9 |
| Moisture content (%): | 4.3 | 4.3 | 4.5 | 4.3 |
| Stiffness M/C (cm$^3$/l): | 84/40 | 82/39 | 84/40 | 79/31 |
| Brightness (%): | 80.0 | 78.1 | 77.0 | 81.0 |
| Ten-point average roughness Rz: (μm) | 15.6 | 18.6 | 21.5 | 16.3 |
| Scratches and wear of photosensitive member and faulty image: | A | B | A–B | B |
| Scratches and wear of fixing rollers and faulty image: | A | B | A–B | B |
| Full-color copy image quality: | A | B | B | B |
| Heat curl: | A | A | A | A–B |
| Practical paper runnability (jamming, etc.): | A | A | A | A |
| Paper dust quantity: | A | A | A | B |

| | Example | | Comparative Example | |
|---|---|---|---|---|
| | 5 | 6 | 1 | 2 |
| Pulp content: (wt. %) | | | | |
| a. Chemical pulp: (virgin pulp) | 15 | 15 | 0 | 50 |
| b. Fine class waste paper pulp: | 75 | 85 | 40 | 16 |
| c. Middle class waste paper pulp: | 10 | 0 | 60 | 34 |
| b. + c.*: | 85 | 85 | 100 | 50 |
| a. + b.**: | 90 | 100 | 40 | 66 |
| Amount of filler: (wt. %) | | | | |
| Calcium carbonate: | 1)18.0 | 2)7.8 | — | — |
| Kaolin: | — | — | 22.0 | 3.8 |
| Paper qualities: | | | | |
| pH of paper-making material: | 7.8 | 7.7 | 5.2 | 5.5 |
| Basis weight (g/m$^2$): | 69.1 | 68.7 | 69.1 | 68.6 |
| Moisture content (%): | 4.4 | 4.3 | 4.5 | 5.0 |
| Stiffness M/C (cm$^3$/l): | 79/31 | 83/39 | 80/32 | 80/32 |
| Brightness (%): | 81.5 | 82.5 | 58.3 | 62.1 |
| Ten-point average roughness Rz: (μm) | 22.7 | 15.8 | 28.8 | 22.3 |
| Scratches and wear of photosensitive member and faulty image: | B | A | B–C | B–C |
| Scratches and wear of fixing rollers and faulty image: | B | A | C | C |
| Full-color copy image quality: | B | A | C | C |
| Heat curl: | A–B | A | A–B | C |
| Practical paper runnability (jamming, etc.): | A | A | A | C |
| Paper dust quantity: | B | A | C | A |

TABLE 3-continued

| | Comparative Example | | |
|---|---|---|---|
| | 3 | 4 | 5 |
| Pulp content: (wt. %) | | | |
| a. Chemical pulp: (virgin pulp) | 32 | 25 | 50 |
| b. Fine class waste paper pulp: | 8 | 40 | 40 |
| c. Middle class waste paper pulp: | 60 | 35 | 10 |
| b. + c.*: | 68 | 75 | 50 |
| a. + b.**: | 40 | 65 | 90 |
| Amount of filler: (wt. %) | | | |
| Calcium carbonate: | 1)22 | — | — |
| Kaolin: | — | 5.0 | 5.0 |
| Paper qualities: | | | |
| pH of paper-making material: | 7.6 | 5.2 | 5.4 |
| Basis weight (g/m$^2$): | 69.5 | 68.7 | 68.5 |
| Moisture content (%): | 4.5 | 4.4 | 4.3 |
| Stiffness M/C (cm$^3$/l): | 78/35 | 83/39 | 82/29 |
| Brightness (%): | 61.0 | 63.0 | 77.5 |
| Ten-point average roughness Rz: (μm) | 26.4 | 15.3 | 15.5 |
| Scratches and wear of photosensitive member and faulty image: | C | C | A |
| Scratches and wear of fixing rollers and faulty image: | C | C | A |
| Full-color copy image quality: | C | C | B |
| Heat curl: | A–B | A | B |
| Practical paper runnability (jamming, etc.): | C | A | C |
| Paper dust quantity: | C | B | A |

In Table 3;
*Waste paper pulp content
**Fine class pulp
Calcium carbonate:
1): Heavy calcium carbonate
2): Precipitated calcium carbonate
Scratches and wear of photosensitive member/fixing rollers and faulty image:
A: Scratches are hardly seen as a result of visual check on the surfaces of the photosensitive member and fixing rollers.
B: Scratches are seen as a result of visual check on the surfaces of the photosensitive member and fixing rollers, but images are not affected.
C: Scratches are conspicuously seen as a result of visual check on the surfaces of the photosensitive member and fixing rollers, and faulty images have occurred.
Full-color copy image quality:
A: Good (tint, color reproduction and coloring are all good).
B: A little poor.
C: Poor (dullness is seen and coloring is unclear)
Heat curl, practical paper runnability (jamming, etc.), and paper dust quantity:
A: Good (no problem on paper runnability)
B: A little poor.
C: Poor (jamming frequently occurs and any faulty images occur.

As is seen from Table 3, compared with Comparative Examples 1 to 4, Examples 1 to 6 show remarkable differences in scratches and wear of photosensitive members and fixing rollers and in faulty images. It can be considered that good results have been obtained because of the fine class pulp mixed in a content of 90% by weight or more as intended in the present invention.

With regard to the heat curl, Examples 1 to 6 and Comparative Examples 1, 3 and 4 show good results, but Comparative Example 2, a poor result. This is considered due to the fact that the filler is contained only in an amount of 3.8% by weight even though the middle class waste paper pulp is in a relatively large content of 34% by weight compared with other paper and hence the curl has greatly occurred. In this regard, in Comparative Examples 1 and 3, the curl is at a good level even though the middle class waste paper pulp is in a content of 60% by weight. This is considered due to the fact that the filler is contained in an amount of 22% by weight. However, since the heavy calcium carbonate is used in a large amount in Comparative Examples 1 and 3, heavy calcium carbonate is used particularly in Comparative Example 3, so that a little poor results are seen in respect of scratches of photosensitive members, scratches of fixing rollers, wear, and fixed images. With regard to the practical paper runnability, the recycled paper of Comparative Example 3 contains calcium carbonate in a large amount and hence the wear of paper feed rollers has occurred so early that faulty paper feed has occurred earlier than in the case of other paper. Comparative Example 2 shows a poor paper runnability because of the problem of the heat curl previously noted. With regard to paper dust quantity, results becomes poor with an increase in the amount of the filler, and in Comparative Examples 1 and 3 faulty images have occurred because of leakage.

With regard to the full-color copy image quality, compared with Comparative Examples 1 to 4, Examples 1 to 6 show remarkable differences (i.e., a good full-color copy image quality). This is remarkably expressed as differences in brightness. Thus the full-color copy image quality can be said be greatly influenced by the brightness of the underlying paper.

In Comparative Example 5, the heat curl has a little greatly occurred and the practical paper runnability is lowered since the waste paper pulp content is 50% by weight which is lower than that in Examples 1 to 6. Examples 2 to 5 are Reference Examples since their pulp fines content is less than 95% by weight.

What is claimed is:

1. A recycled paper for electrophotography, comprising at least a pulp fine and a filler, wherein said pulp fine is present in amounts of not less than 95% by weight based on the weight of the whole pulp, said filler is present in an amount of not more than 8% by weight, and said recycled paper has (i) a waste paper pulp content of more than 70% by weight based on the weight of the whole pulp and (ii) a ten-point average roughness $R_z$ of 21 μm or less measured according to Japanese Industrial Standard B0601-1982.

2. The recycled paper according to claim 1, wherein said recycled paper has a waste paper pulp content of more than 75% by weight based on the weight of the whole pulp.

3. The recycled paper according to claim 1, wherein said pulp fine from waste paper pulp has a fiber diameter of from 10 μm to 70 μm.

4. The recycled paper according to claim 1, wherein said pulp fine from waste paper pulp has a fiber diameter of from 10 μm to 50 μm.

5. The recycled paper according to claim 1, wherein said filler comprises calcium carbonate, kaolin, talc or titanium dioxide.

6. The recycled paper according to claim 1, wherein said filler has a weight average particle diameter of 20 μm or less.

7. The recycled paper according to claim 1, wherein said filler has a weight average particle diameter of from 1 μm to 15 μm.

8. The recycled paper according to claim 1, wherein said recycled paper has a ten-point average roughness Rz of 16 μm or less.

9. The recycled paper according to claim 1, wherein said recycled paper has a basis weight of from 60 g/cm$^2$ to 90 g/cm$^2$.

10. The recycled paper according to claim 1, wherein said recycled paper has a basis weight of from 64 g/cm$^2$ to 80 g/cm$^2$.

11. The recycled paper according to claim 1, wherein said recycled paper has a moisture content of from 3.5% to 6%.

12. The recycled paper according to claim 1, wherein said recycled paper has a moisture content of from 4% to 5%.

13. The recycled paper according to claim 1, wherein said recycled paper has a brightness of 75% or above measured according to Japanese Industrial Standard P8123-1961.

14. The recycled paper according to claim 13, wherein said recycled paper has a brightness of 78% or above.

15. The recycled paper according to claim 1, wherein said recycled paper has a stiffness M/C measured according to Japanese Industrial Standard P8143-1967 of $85\pm10$ $cm^3/100$ in length and $40\pm10$ $cm^3/100$ in breadth.

16. The recycled paper according to claim 1, wherein said recycled paper has a stiffness M/C measured according to Japanese Industrial Standard B8143-1967 of $90\pm5$ $cm^3/100$ in length and $45\pm cm^3/100$ in breadth.

17. The recycled paper according to claim 1, wherein said recycled paper is an acidic paper having a pH smaller than 7.0 as the pH of paper-extracted water.

18. The recycled paper according to claim 1, wherein said recycled paper is a neutralized paper having a pH 7.0 or above as the pH of paper-extracted water.

19. The recycled paper according to claim 1, wherein a paper-making material used for producing said recycled paper has a pH of from 3.8 to 6.

20. The recycled paper according to claim 1, wherein a paper-making material used for producing said recycled paper has a pH of from 7 to 8.

21. The recycled paper according to claim 1, wherein said recycled paper is a neutralized paper having a pH 7.0 or above as the pH of paper-extracted water and contains calcium carbonate.

22. The recycled paper according to claim 1, wherein said recycled paper is a neutralized paper having a pH 7.0 or above as the pH of paper-extracted water and contains heavy calcium carbonate.

23. The recycled paper according to claim 1, wherein a paper-making material used for producing said recycled paper has a pH of from 7 to 8 and contains heavy calcium carbonate.

* * * * *

UNITED STATES PATENT AND TRADEMARK OFFICE

CERTIFICATE OF CORRECTION

PATENT NO. : 5,403,445

DATED : April 4, 1995

INVENTOR(S) : YOSHINOBU SHIMOMURA, ET AL.

It is certified that error appears in the above-identified patent and that said Letters Patent is hereby corrected as shown below:

COLUMN 4

Line 16, "Pollers." should read --rollers.--.
Line 34, "filler;" should read --filler,--.

COLUMN 5

Line 17, "comprising;" should read --comprising:--.

COLUMN 6

Line 5, "apparatus." should read --apparatus; and--.
Line 12, "AS" should read --As--.
Line 44, "prevent" should read --reduce--.

COLUMN 7

Line 39, "cause" should read --caused--.

COLUMN 9

Line 28, "in" should read --is--.

COLUMN 11

Line 11, "uneveness." should read --unevenness.--.

COLUMN 12

Line 30, "scratched" should read --scratches--.
Line 46, "Example 2" should be centered.

UNITED STATES PATENT AND TRADEMARK OFFICE

CERTIFICATE OF CORRECTION

PATENT NO. : 5,403,445

DATED : April 4, 1995

INVENTOR(S) : YOSHINOBU SHIMOMURA, ET AL.

It is certified that error appears in the above-identified patent and that said Letters Patent is hereby corrected as shown below:

COLUMN 13

Line 9, "respectively images" should read --respectively. Images--.
Line 15, "Examples 5" should read --Example 5--.
Line 20, "calandaring" should read --calendering--.

COLUMN 14

Line 3, "calandaring" should read --calendering--.
Line 41, "calandaring" should read --calendering--.

COLUMN 18

Line 10, "comes" should read --come--.

COLUMN 19

Line 24, "B8143-1967" should read --P8143-1967--.

Signed and Sealed this

Eighteenth Day of July, 1995

Bruce Lehman

BRUCE LEHMAN

*Commissioner of Patents and Trademarks*

*Attest:*

*Attesting Officer*